US008186803B2

(12) United States Patent
Ito

(10) Patent No.: US 8,186,803 B2
(45) Date of Patent: May 29, 2012

(54) METHOD FOR INSPECTING DROPLET DISCHARGE HEAD, DEVICE FOR INSPECTING DROPLET DISCHARGE HEAD, AND DROPLET DISCHARGE DEVICE

(75) Inventor: Yoshihiro Ito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

(21) Appl. No.: 12/720,086

(22) Filed: Mar. 9, 2010

(65) Prior Publication Data

US 2010/0238229 A1 Sep. 23, 2010

(30) Foreign Application Priority Data

Mar. 19, 2009 (JP) ..... 2009-067548

(51) Int. Cl.
*B41J 29/393* (2006.01)

(52) U.S. Cl. ..... 347/19; 347/9; 347/15

(58) Field of Classification Search ..... 347/5, 9, 347/14, 15, 19
See application file for complete search history.

(56) References Cited

U.S. PATENT DOCUMENTS 6,743,645 B2 * 6/2004 Kubota et al. ..... 438/14

FOREIGN PATENT DOCUMENTS

JP 2007-144344 A 6/2007

* cited by examiner

*Primary Examiner* — Juanita D Jackson
(74) *Attorney, Agent, or Firm* — Global IP Counselors, LLP

(57) ABSTRACT

A method for inspecting a droplet discharge head includes discharging a plurality of droplets on an inspection workpiece from a nozzle row of the droplet discharge head at least twice in different positions on the inspection workpiece thereby forming a plurality of dot pattern rows each including a plurality of dot patterns, inspecting each of the dot patterns included in a first dot pattern row among the dot pattern rows by sequentially acquiring, using an image processing, a predetermined inspection value of the each of the dot patterns determined based on a shape of the each of the dot patterns, and initiating inspection of a second dot pattern row among the dot pattern rows when inspection of the first dot pattern row is interrupted upon one of the predetermined inspection values sequentially acquired exceeding a predetermine threshold established in advance according to a type of the predetermined inspection value.

11 Claims, 7 Drawing Sheets

METHOD FOR INSPECTING DROPLET DISCHARGE HEAD, DEVICE FOR INSPECTING DROPLET DISCHARGE HEAD, AND DROPLET DISCHARGE DEVICE

CROSS-REFERENCE TO RELATED APPLICATIONS

This application claims priority to Japanese Patent Application No. 2009-067548 filed on Mar. 19, 2009. The entire disclosure of Japanese Patent Application No. 2009-067548 is hereby incorporated herein by reference.

BACKGROUND

1. Technical Field

The present invention relates to a method for inspecting a droplet discharge head, a device for inspecting a droplet discharge head, and a droplet discharge device.

2. Related Art

Electro-optic devices are currently being manufactured using inkjet-type droplet discharge devices. Examples of electro-optic devices include liquid crystal display devices, organic EL (electro luminescence) devices, and other devices that use color filters. When these electro-optic devices are manufactured using a droplet discharge device, droplets must be discharged (dripped) in a predetermined amount with extreme accuracy from a droplet discharge head to a predetermined position on a discharge target.

Japanese Laid-Open Patent Application No. 2007-144344 discloses an invention of a method and device for inspecting a dot pattern of a plurality of droplets discharged from a nozzle array of a droplet discharge head. In the invention of Japanese Laid-Open Patent Application No. 2007-144344, an area where a dot pattern is to be formed on a workpiece designed for inspection is observed with a camera, and if there is any dust or other matter that would inhibit inspection in this portion, this area is avoided in the formation of a dot pattern for inspection, whereby the dot pattern inspection can be performed appropriately.

SUMMARY

However, in cases in which there are miniature abrasions, cracks, or other defects in the area where a dot pattern is to be formed on the workpiece designed for inspection, it is difficult for the image to be recognized with the camera, and there is a problem in that the defects cannot be avoided. Specifically, these defects have the characteristic of first becoming exposed when droplets are discharged thereon.

When droplets are dripped from the droplet discharge head onto an area having miniature abrasions, cracks, or the like; the droplets flow out along the abrasions or cracks, the dot pattern for inspection changes in shape, and adjacent dot patterns join together. In such cases, since the dot pattern cannot be accurately inspected, a dot pattern must be formed again on the workpiece designed for inspection, and another attempt (retry) at inspection must be made. Therefore, the time for dot pattern inspection increases, which affects the subsequent product manufacturing step.

The present invention was devised in view of the problems described above, and an object thereof is to provide a method for inspecting a droplet discharge head, a device for inspecting a droplet discharge head, and a droplet discharge device whereby the time for inspecting the dot pattern can be reduced.

In order to solve the problems described above, a method for inspecting a droplet discharge head according to a first aspect includes discharging a plurality of droplets on an inspection workpiece from a nozzle row of the droplet discharge head at least twice in different positions on the inspection workpiece thereby forming a plurality of dot pattern rows each including a plurality of dot patterns, inspecting each of the dot patterns included in a first dot pattern row among the dot pattern rows by sequentially acquiring, using an image processing, a predetermined inspection value of the each of the dot patterns determined based on a shape of the each of the dot patterns, and initiating inspection of a second dot pattern row among the dot pattern rows when inspection of the first dot pattern row is interrupted upon one of the predetermined inspection values sequentially acquired exceeding a predetermine threshold established in advance according to a type of the predetermined inspection value.

Using this method makes it possible to discharge droplets at least twice from the same nozzle row onto the inspection workpiece, to form the dot-pattern rows in a plural number for inspection in advance, and to proceed with the inspection by using a dot-pattern row formed at a different position than a dot-pattern row having defects. Therefore, there is no longer a need to retry inspection by forming dot patterns again on the inspection workpiece, and the time for dot pattern inspection can be reduced.

In the method for inspecting a droplet discharge head according to a second aspect, the initiating of the inspection of the second dot pattern row preferably includes initiating the inspection of the second dot pattern row, which is adjacent to the first dot pattern row.

Using this method makes it possible to reduce the time needed to make a transition to a different inspection row when a transition is made between dot-pattern rows.

In the method for inspecting a droplet discharge head according to a third aspect, the inspecting of the each of the dot patterns preferably includes using a value of the surface area of the each of the dot patterns as the predetermined inspection value.

Using this method makes it possible to determine the presence of defects on the basis of the surface area values when droplets flow along abrasions or the like because the dot patterns extend along the abrasions or the like and their surface areas increase.

In the method for inspecting a droplet discharge head according to a fourth aspect, the inspecting of the each of the dot patterns preferably includes using a value of the barycentric position of the each of the dot patterns as the predetermined inspection value.

By using this method, the presence of defects is determined based on values of the barycentric positions when droplets flow along abrasions or the like because the dot patterns extend along the abrasions or the like and the barycentric positions become misaligned.

In the method for inspecting a droplet discharge head according to a fifth aspect, the initiating of the inspection of the second dot pattern row preferably includes interrupting the inspection of the first dot pattern row when one of the barycentric positions of the dot patterns sequentially acquired deviates in a direction orthogonal to a row direction of the first dot pattern row by an amount exceeding the predetermined threshold, and initiating the inspection of the second dot pattern row disposed adjacent to the first dot pattern row on a side of the first dot pattern row toward which the one of the barycentric positions deviates by the amount exceeding the predetermined threshold.

Using this method makes it possible, in cases in which the barycentric position of a dot pattern has become misaligned to either side in a direction orthogonal to the dot-pattern row, to determine if the dot pattern has become joined to a dot pattern included in a dot-pattern row adjacent in that direction to the first dot-pattern row. Specifically, there is a high probability that the dot-pattern row on that side will exhibit abnormal values when inspected. Therefore, another dot-pattern row that is separate from the first dot-pattern row is inspected, whereby ineffective inspections can be eliminated, contributing to reducing the inspection time.

A device for inspecting a droplet discharge head according to another aspect includes a drive unit, an inspection photography unit, and a control unit. The drive unit is configured and arranged to drive the droplet discharge head to discharge a plurality of droplets on an inspection workpiece from a nozzle row of the droplet discharge head at least twice in different positions on an inspection workpiece thereby forming a plurality of dot pattern rows each including a plurality of dot patterns. The inspection photography unit is configured and arranged to capture an image of the dot patterns formed on the inspection workpiece. The control unit is configured to inspect each of the dot patterns included in a first dot pattern row among the dot pattern rows by sequentially acquiring, using an image processing, a predetermined inspection value of the each of the dot patterns determined based on a shape of the each of the dot patterns captured in the image by the inspection photography unit, to stop inspection of the first dot pattern row upon one of the predetermined inspection values sequentially acquired exceeding a predetermine threshold established in advance according to a type of the predetermined inspection value, and to initiate inspection of a second dot pattern row among the dot pattern rows after stopping the inspection of the first dot pattern row.

Using this configuration makes it possible to discharge droplets at least twice from the same nozzle row onto the inspection workpiece, to form the dot-pattern rows in a plural number for inspection in advance, and to proceed with the inspection by using a dot-pattern row formed at a different position than a dot-pattern row having defects. Therefore, there is no longer a need to retry inspection by forming dot patterns again on the inspection workpiece, and the time for dot pattern inspection can be reduced.

A droplet discharge device according to another aspect includes the device for inspecting a droplet discharge head as described above.

BRIEF DESCRIPTION OF THE DRAWINGS

Referring now to the attached drawings which form a part of this original disclosure.

DETAILED DESCRIPTION OF EXEMPLARY EMBODIMENTS

The following is a description, made with reference to the accompanying drawings, of an embodiment of a method for inspecting a droplet discharge head, a device for inspecting a droplet discharge head, and a droplet discharge device having this device, all according to the present invention. The droplet discharge device of the present embodiment is installed in a drawing system incorporated in a manufacturing line for FPDs (flat panel displays) of liquid crystal display devices, wherein specialized ink, a luminescent resin liquid, or another functional liquid is introduced into a droplet discharge head, and a film is formed by the functional liquid on a color filter or another substrate.

Figure 1:
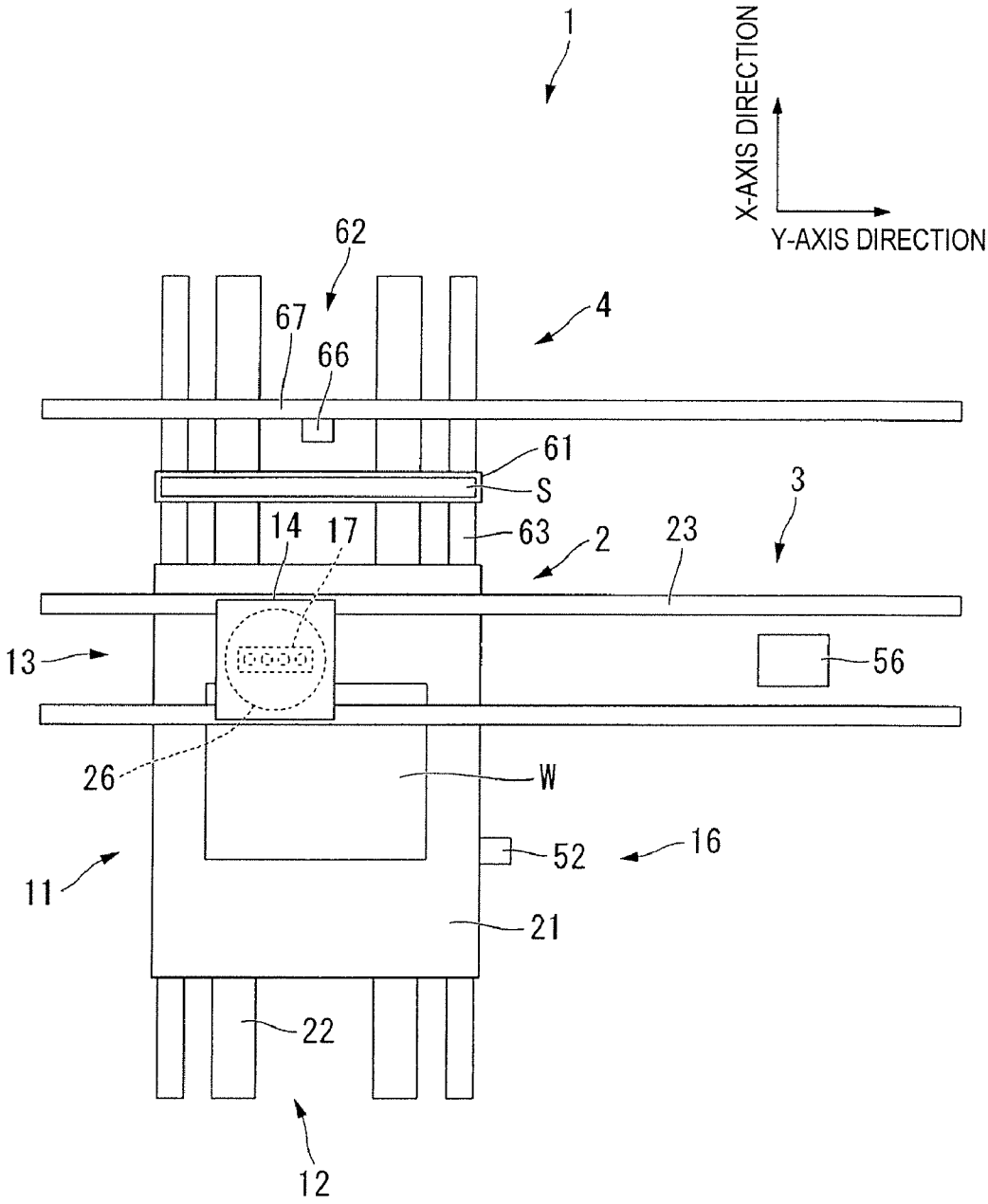
FIG. 1 is a schematic plan view of a droplet discharge device according to an embodiment of the present invention.
Figure 2:
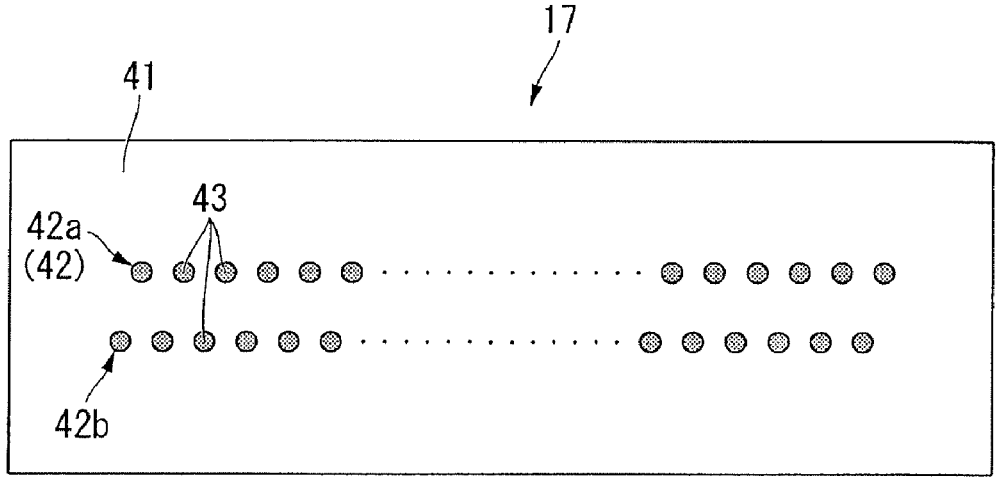
FIG. 2 is a schematic view of a functional liquid droplet discharge head according to an embodiment of the present invention as seen from the side of the nozzle surface.
Figure 3:
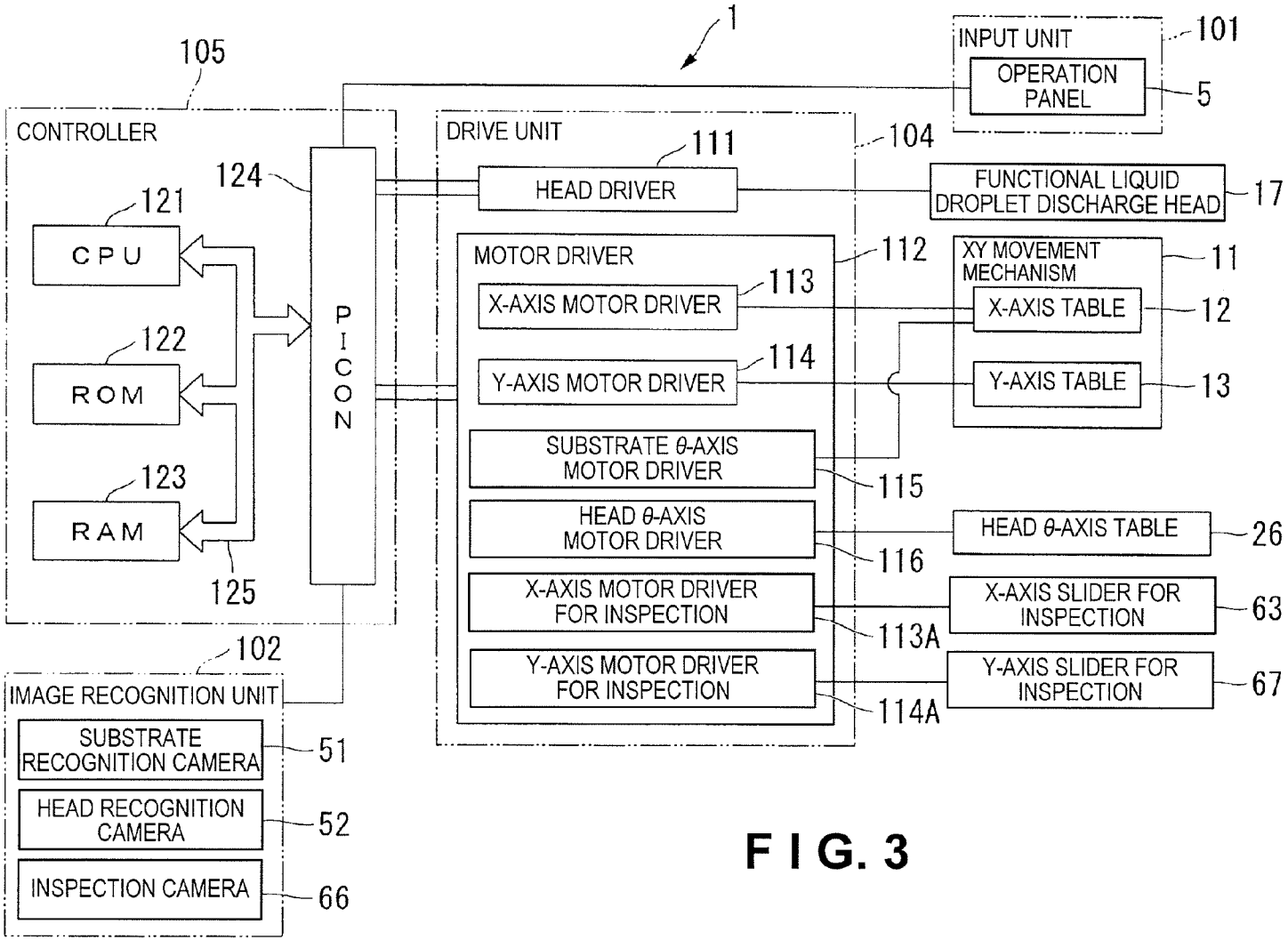
FIG. 3 is a block diagram showing the control system of the droplet discharge device according to an embodiment of the present invention.
Figure 4:
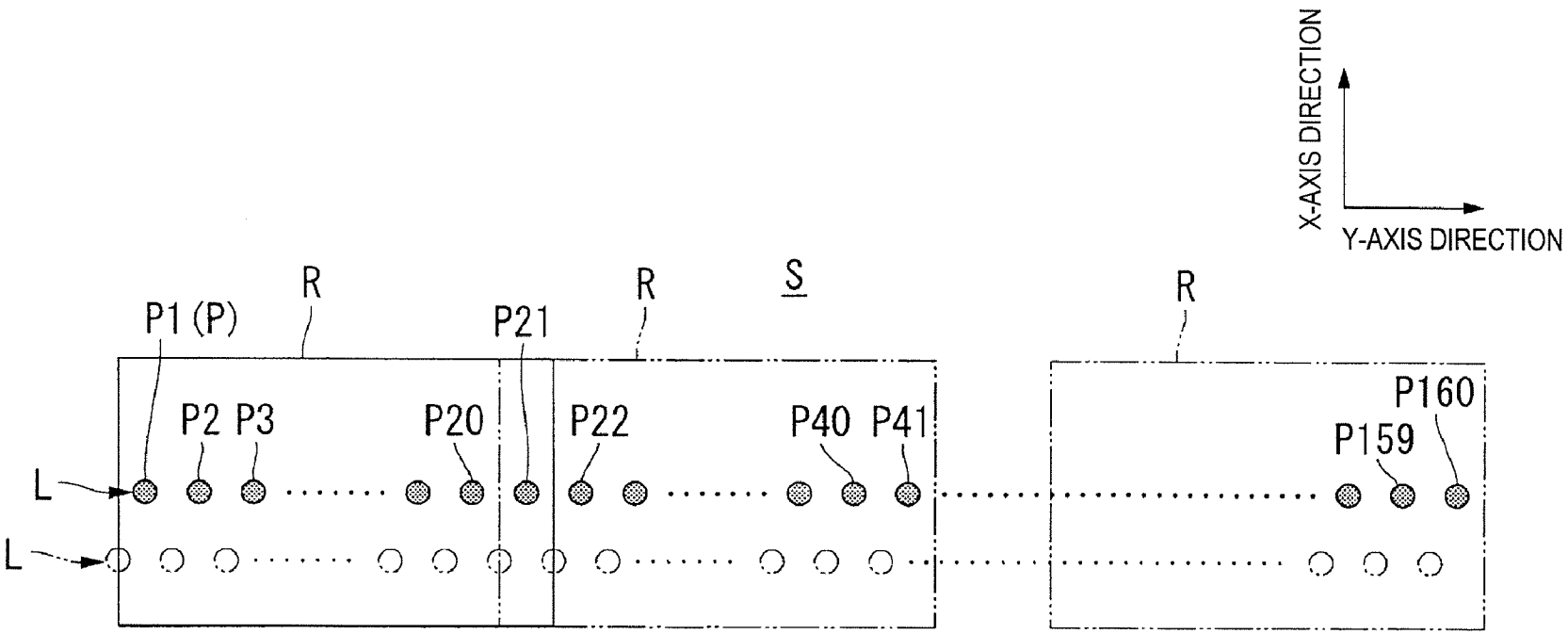
FIG. 4 is a schematic plan view showing the inspection area of an inspection camera according to an embodiment of the present invention.

FIG. 1 is a schematic plan view of a droplet discharge device according to an embodiment of the present invention. FIG. 2 is a schematic view of a functional liquid droplet discharge head as seen from the side of the nozzle surface. FIG. 3 is a block diagram showing the control system of the droplet discharge device. FIG. 4 is a schematic plan view showing the inspection area of an inspection camera.

A droplet discharge device 1 has a drawing device 2 having a plurality of functional liquid droplet discharge heads (droplet discharge heads) 17, a maintenance device 3 provided to the drawing device 2, and a discharge inspection unit (inspection device) 4 for performing discharge inspection on the functional liquid droplet discharge heads 17, as shown in FIG. 1. The droplet discharge device 1 also has an operation panel 5 for inputting various data, and a controller (control unit) 105 for collectively controlling all components as shown in FIG. 3. In FIG. 1, only one functional liquid droplet discharge head 17 is shown for the sake of simplicity.

The droplet discharge device 1 is configured to perform, under the control of the controller 105, a maintenance process for maintaining or restoring the discharge function of the functional liquid droplet discharge heads 17 by using the maintenance device 3, a functional liquid droplet discharge head inspection process for inspecting the dot pattern of the functional liquid droplet discharge heads 17 by using the discharge inspection unit 4, and an actual drawing process for discharging and depositing functional liquid droplets onto a substrate W (workpiece for actual drawing) by using the drawing device 2.

The drawing device 2 has an XY movement mechanism 11 composed of an X-axis table 12 for moving the substrate W in an X-axis direction, and a Y-axis table 13 for moving a carriage 14, which carries the functional liquid droplet discharge heads 17, in a Y-axis direction orthogonal to the X-axis direction.

The area of intersection between the trajectory of movement of the substrate W by the X-axis table 12 and the trajectory of movement of the carriage 14 by the Y-axis table 13 is the drawing area where the actual drawing process is performed. The area (to the right in the drawing) outside of the X-axis table 12 on the trajectory of movement of a head unit 15 by the Y-axis table 13 is a maintenance area. Part of the maintenance device 3 is disposed in this maintenance area. The area in front of the X-axis table 12 is a substrate loading/unloading area for loading and unloading the substrate W to and from the droplet discharge device 1.

The X-axis table 12 has a positioning table 21 for positioning the substrate W, and a drawing X-axis slider 22 for supporting the positioning table 21 and sliding the positioning table in the X-axis direction.

The positioning table 21 is equipped with a vacuum-suction table for positioning the substrate W by vacuum suction, a substrate θ-axis table for finely adjusting the θ position of the substrate W, and other components. The drawing X-axis slider 22 is driven by an X-axis motor driver 113 (see FIG. 3) constituting an X-axis direction drive system.

The Y-axis table 13 is designed to straddle the X-axis table 12 and is supported by left and right support rods (not shown) set up on the floor. The Y-axis table has the carriage 14 is mounted with the functional liquid droplet discharge heads 17, and a drawing Y-axis slider 23 for supporting the carriage 14 and sliding the carriage in the Y-axis direction.

The carriage 14 has a head θ-axis table 26 for holding the plurality of functional liquid droplet discharge heads 17 and correcting the θ-position of the heads. In the present embodiment, there is only one carriage 14, but any desired number of carriages can be used. The drawing Y-axis slider 23 is driven by a Y-axis motor driver 114 (see FIG. 3) constituting a Y-axis direction drive system.

The functional liquid droplet discharge heads 17 are supplied with a functional liquid from a functional liquid pack or the like (not shown), and the heads then discharge the functional liquid through an inkjet system (e.g., driven by a piezoelectric element), as shown in FIG. 2. The functional liquid droplet discharge heads 17 each have two nozzle rows 42 (nozzle rows 42*a*, 42*b*) formed in parallel to each other on a nozzle surface 41.

The length of each nozzle row 42 is 1 inch (about 25.4 mm), for example, and each nozzle row 42 is configured with 180 nozzles 43 aligned at a regular pitch (about 140 μm). The distance between two nozzle rows 42 is about 2.2 mm, for example.

In the internal flow channel structures of the heads, the amounts discharged from the nozzles 43 placed at the ends are greater than the amounts discharged from the nozzles 43 placed in the center. Therefore, the ten nozzles 43 at the ends are designated as non-discharge nozzles while the 160 nozzles 43 in the center are designated as discharge nozzles, the functional liquid is discharged only from the discharge nozzles, and functional liquid is not discharged from the non-discharge nozzles.

The droplet discharge device 1 has an alignment device 16 as shown in FIG. 1. The alignment device 16 has a substrate recognition camera 51 (see FIG. 3) for imaging and recognizing alignment marks (not shown) for the substrate W, and a head recognition camera 52 (see FIGS. 1 and 3) for imaging and recognizing alignment marks (not shown) for the functional liquid droplet discharge heads 17.

In the maintenance area, the maintenance device 3 has a suction unit 56 for suctioning the functional liquid from the nozzles 43 of the functional liquid droplet discharge heads 17, a wiping unit (not shown) for wiping down the nozzle surface 41 of the functional liquid droplet discharge heads 17, a splatter monitoring unit (not shown) for monitoring the splattering of the functional liquid droplets, and other components.

The discharge inspection unit 4 has a drawn unit 61 whereby inspection roll paper (workpiece being inspected) S provided with a dot-pattern row L (see FIG. 4) designed for inspection and created by the functional liquid droplet discharge heads 17 is pulled out in the Y-axis direction, and an inspection photography unit 62 for photographing the dot-pattern row L.

The discharge inspection unit 4 creates an image and recognizes the drawn result of the dot-pattern row L formed by the functional liquid droplet discharge heads 17, and inspects whether or not the functional liquid droplets have been properly discharged from the nozzles 43.

The drawn unit 61 has an inspection X-axis slider 63 for moving the inspection roll paper S in the X-axis direction, and a winding mechanism (not shown) for winding up the inspection roll paper S.

The inspection X-axis slider 63 is provided independently of the drawing X-axis slider 22 and is driven by an inspection X-axis motor driver 113A (see FIG. 3) constituting an X-axis direction drive system. In the present embodiment, the drawn unit 61 and the positioning table 21 are mounted on separate X-axis sliders, but they may also be mounted on the same X-axis slider.

The winding mechanism is configured to cause the undrawn area to face the nozzle surface 41 of the functional liquid droplet discharge heads 17 by winding up a predetermined length (e.g., 50 m) of the inspection roll paper S in the Y-axis direction. This winding is performed with each functional liquid droplet discharge head inspection process, for example.

The inspection roll paper S is inspection paper wound up into the shape of a roll, and has a base material layer and a receiving layer that is formed (coated) over the surface of the base material layer and can be penetrated by functional liquid droplets.

The inspection roll paper S has a width (e.g., 100 mm) corresponding to a plurality of inspection drawings. The inspection roll paper S also has a predetermined length (e.g., 50 m) intended to reduce the frequency of replacing paper.

The workpiece designed for inspection and subject to the discharge of the functional liquid droplet discharge heads 17 is not limited to the inspection roll paper S, and may also be a strip of inspection paper, for example. The frequency of replacing paper can be reduced, however, by using a roll of inspection paper. Furthermore, although it requires a cleaning process, a glass substrate can be used.

The inspection photography unit 62 has an inspection camera 66 (photography camera) for photographing a dot pattern L (drawing result) drawn on the inspection roll paper S, and an inspection Y-axis slider 67 for moving the inspection camera 66 in the Y-axis direction.

The inspection camera 66 has predetermined inspection regions R (photography regions) as shown in FIG. 4. The inspection camera 66 is a high-resolution (narrow-viewing-angle) CCD (charge-coupled-device) camera, and is configured to be capable of producing photographs that contain a plurality of dot-pattern rows L.

The inspection Y-axis slider 67 is provided independently of the drawing Y-axis slider 23 and is driven by an inspection Y-axis motor driver 114A (see FIG. 3) constituting a Y-axis direction drive system.

The discharge inspection unit 4 of the present embodiment is configured to move the inspection regions R of the inspection camera 66 in the direction of alignment of the dot-pattern rows L (in the Y-axis direction in FIG. 4) to acquire a plurality of images, and to inspect the dot-pattern rows L while connecting the images.

Specifically, when functional liquid droplets are discharged in a single cycle from the nozzle rows 42 of the functional liquid droplet discharge heads 17 to form dot-pattern rows L on the inspection roll paper S, a single dot-pattern row L contains 160 dot patterns P (P1 to P160). Twenty-one dot patterns P are photographed for each image, and the images are connected so that the twenty-first (final) dot pattern P21 of these patterns is also the first dot pattern P of the next image. Specifically, 20 (dots)×8 (images)=160 (dots), and one dot-pattern row L can be inspected with a total of eight images. For the inspection, predetermined inspection values based on the shape of the dot patterns P are sequentially acquired and inspected using an imaging process. These inspection values include the surface area of the dot patterns P, the barycentric position (coordinate position), and other values.

Next, the control system of the entire droplet discharge device 1 will be described with reference to FIG. 3. The control system of the droplet discharge device 1 essentially has an input unit 101 having the operation panel 5 for inputting various data; an image recognition unit 102 having various cameras provided to the alignment device 16 and the discharge inspection unit 4; a drive unit 104 having various drivers for driving the functional liquid droplet discharge heads 17, the XY movement mechanism 11, and other components; and the controller 105 for collectively controlling the droplet discharge device 1, including these components.

The drive unit 104 has a head driver 111 for controlling the discharge driving of the functional liquid droplet discharge heads 17, and a motor driver 112 for drivably controlling the motors of the XY movement mechanism 11 and other components. The head driver 111 generates and applies a predetermined drive waveform in accordance with an instruction from the controller 105, and controls the discharge driving of the functional liquid droplet discharge heads 17. The motor driver 112 has the X-axis motor driver 113, the Y-axis motor driver 114, a substrate θ-axis motor driver 115, a head θ-axis motor driver 116, the inspection X-axis motor driver 113A, and the inspection Y-axis motor driver 114A. These drivers drivably control the drive motors of the X-axis table 12, the Y-axis table 13, the substrate θ-axis table, the head θ-axis table 26, the inspection X-axis slider 63, and the inspection Y-axis slider 67 in accordance with instructions from the controller 105.

The controller 105 has a CPU 121, a ROM 122, a RAM 123, and a P-CON 124, which are all connected to each other via a bus 125. The ROM 122 has a control program region for storing control programs and the like processed by the CPU 121, and a control data region for storing control data and the like for performing the actual drawing process and image recognition.

In addition to various register groups, the RAM 123 has a drawing data region for performing the actual drawing process, a discharge inspection data region for performing the functional liquid droplet discharge head inspection process, an image data region for temporarily storing image data, and other regions; which are used as various operating regions for the control process.

The P-CON 124 is configured with a logic circuit for supplementing the function of the CPU 121 and handling interface signals with the peripheral circuitry. Therefore, the P-CON 124 introduces image data, various instructions from the input unit 101, or the like into the bus 125 either directly or after processing, and, operating in cooperation with the CPU 121, outputs data or control signals inputted to the bus 125 from the CPU 121 or the like to the drive unit 104 either directly or after processing.

After inputting various detection signals, various instructions, various data, and the like via the P-CON 124 in accordance with a control program in the ROM 122 and processing the various data and the like in the RAM 123, the CPU 121 controls the entire droplet discharge device 1 by outputting various control signals to the drive unit 104 and other components via the P-CON 124.

For example, the CPU 121 controls the functional liquid droplet discharge heads 17, the X-axis table 12, and the Y-axis table 13 to draw patterns on the substrate W under predetermined droplet discharge conditions and predetermined movement conditions.

A simple description is given herein of a series of actual drawing processes performed on the substrate W by the droplet discharge device 1. First, the substrate W is set on the positioning table 21 which has been moved to the substrate loading/unloading area, and a substrate alignment process is performed based on the results provided by the substrate recognition camera 51 in recognizing the image of substrate alignment as a preparation prior to the discharge of functional liquid droplets.

The functional liquid droplets are discharged while the functional liquid droplet discharge heads 17 are moved relative to the substrate W. Specifically, main scanning, in which functional liquid droplets are discharged and deposited from the plurality of functional liquid droplet discharge heads 17 onto the substrate W while the substrate W is moved in the X-axis direction by the X-axis table 12, and sub scanning, in which the head unit 15 is moved in the Y-axis direction by the Y-axis table 13, are performed repeatedly, and functional liquid droplets are discharged (drawn) over the entire substrate W.

Figure 5:
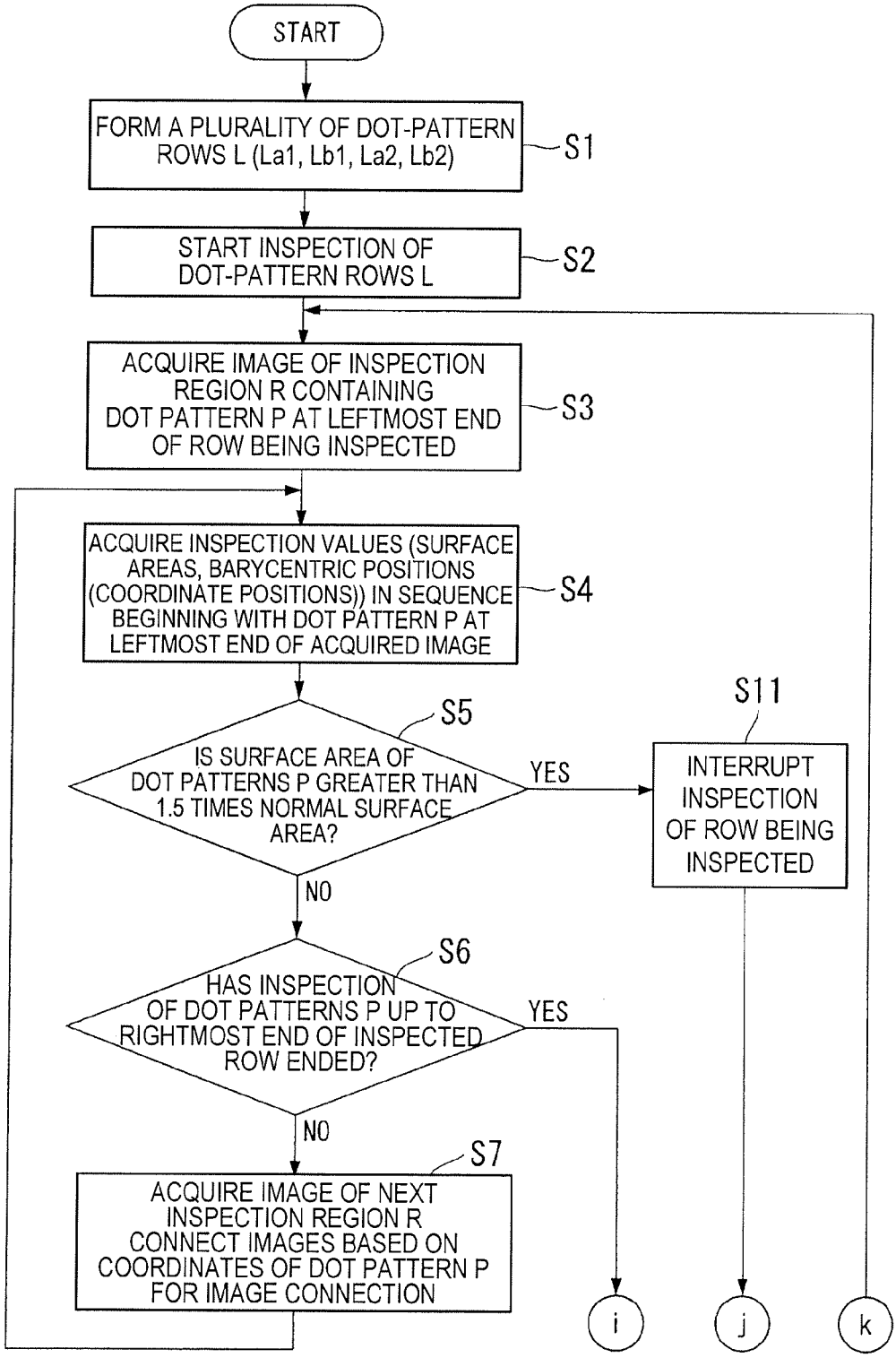
FIG. 5 is a flowchart of the functional liquid droplet discharge head inspection process according to an embodiment of the present invention.
Figure 6:
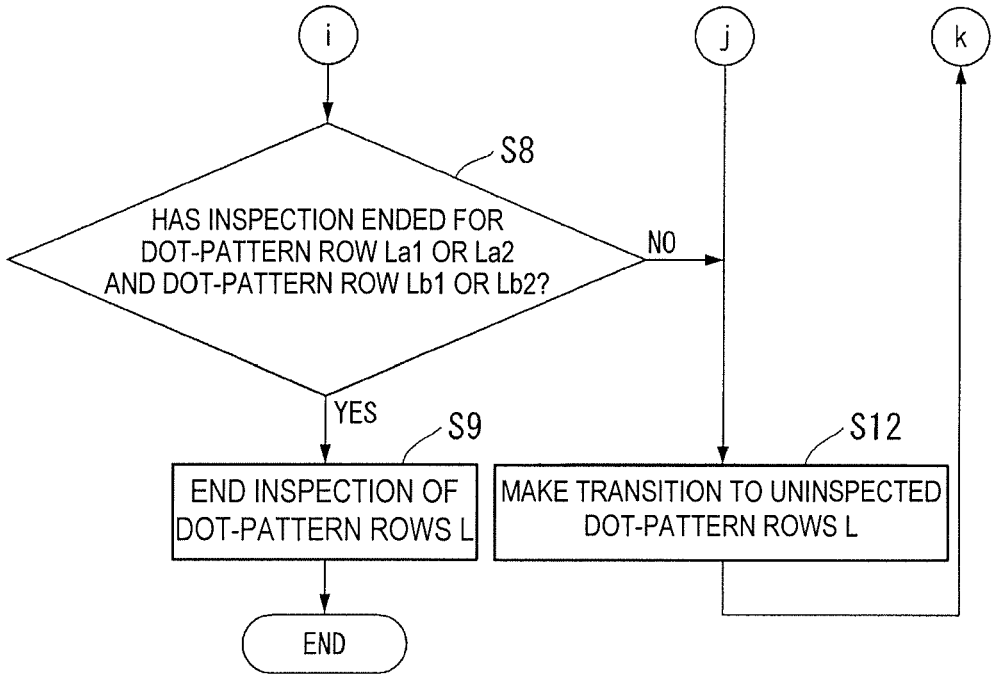
FIG. 6 is a flowchart of the functional liquid droplet discharge head inspection process according to an embodiment of the present invention.
Figure 7:
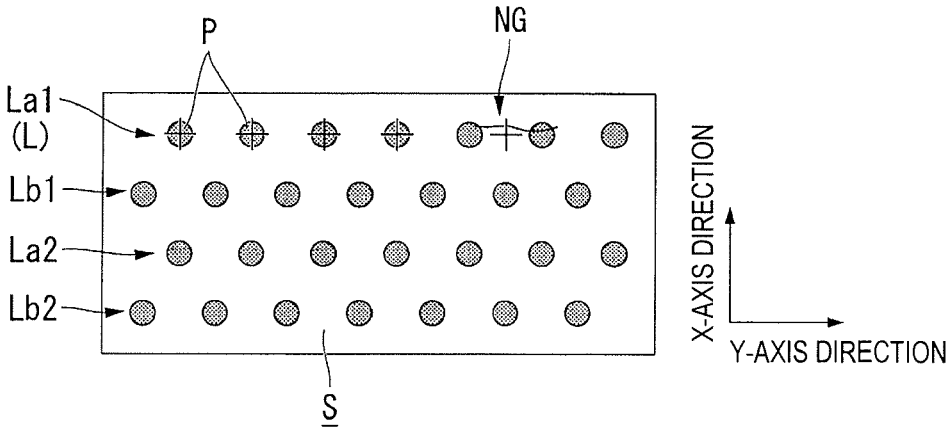
FIG. 7 is a view showing a plurality of dot-pattern rows formed on inspection roll paper according to an embodiment of the present invention.

The following is a detailed description, made with reference to FIGS. 5 to 7, of the functional liquid droplet discharge head inspection process (method for inspecting the functional liquid droplet discharge heads) of the discharge inspection unit 4.

FIG. 5 is a flowchart of the functional liquid droplet discharge head inspection process. FIG. 6 is a flowchart of the functional liquid droplet discharge head inspection process. FIG. 7 is a view showing a plurality of dot-pattern rows formed on inspection roll paper.

The functional liquid droplet discharge head inspection process is performed before and after the actual drawing process described above, wherein the discharge state of the nozzles 43 of the functional liquid droplet discharge heads 17 is inspected. In cases in which no deviations from normal operation are confirmed in the nozzles 43 by the functional liquid droplet discharge head inspection process, the next actual drawing process is then performed; and in cases in which a deviation from normal operation is confirmed, a maintenance process is performed on the functional liquid droplet discharge heads 17 before the next actual drawing process is performed.

In this process, first, functional liquid droplets are discharged from the nozzle rows 42 at least twice onto mutually different positions on the inspection roll paper S, and a plurality of dot-pattern rows L is formed (dot-pattern row formation process (step)).

Specifically, in the present embodiment, the controller 105 first causes the functional liquid droplet discharge heads 17 and the inspection roll paper S to face each other. Next, the controller 105 discharges functional liquid droplets from the nozzle rows 42 (42*a*, 42*b*) a total of two times onto positions staggered in the X-axis direction, and forms a total of four dot-pattern rows L (La1, Lb1, La2, Lb2) (step S1).

The dot-pattern row formed by the nozzle row 42*a* contains the dot-pattern row La1 and the dot-pattern row La2, as shown in FIG. 7. The dot-pattern row formed by the nozzle row 42*b* contains the dot-pattern row Lb1 and the dot-pattern row Lb2.

These dot-pattern rows are formed at predetermined distances from each other (e.g., distance between nozzle rows) with their alphanumeric symbols being aligned in the order La1, Lb1, La2, Lb2 in the X-axis direction.

Next, in this process, a specified row is selected from among the plurality of dot-pattern rows L, and predetermined inspection values based on the shapes of the dot patterns P are sequentially acquired and inspected using an imaging process for every dot pattern P included in the dot-pattern row (dot pattern inspection process (step)).

Specifically, in the present embodiment, the controller 105 first selects a dot-pattern row La1 and begins inspection (step S2). Next, the controller 105 causes the inspection camera 66 to make a transition (to initiate inspection of the next dot-pattern row) and acquire an image of the inspection region R that includes the dot pattern P at the farthest left end of the dot-pattern row La1 (step S3). Under the control of the controller 105, the discharge inspection unit 4 uses an imaging process to acquire the surface areas of the dot patterns P, the barycentric positions (coordinate positions), and other inspection values in a sequence that starts with the dot pattern P position at one end (the leftmost end) of the dot-pattern row La1 (step S4). The cross symbols in FIG. 7 indicate the barycentric positions of the dot patterns P.

There are cases in which miniature abrasions, cracks, and other defects that make image recognition difficult are present in the inspection roll paper S. Specifically, these defects have the characteristic of being exposed only when droplets are discharged thereon, making it difficult to avoid these areas in advance when forming the dot-pattern rows L.

When functional liquid droplets are dripped from the functional liquid droplet discharge heads 17 onto an area in which miniature abrasions, cracks, or the like are present, the functional liquid droplets flow out along the abrasions or cracks, and the shape of the dot pattern P for inspection changes. For example, a dot pattern NG may be formed having an abnormal shape in which adjacent dot patterns P are joined together, as shown in FIG. 7. This dot pattern NG is recognized as an image in the form of a single dot pattern P, and the inspection values thereof indicate abnormal values that deviate from the inspection values normally expected of proper dot patterns P.

The inspection of the selected dot-pattern row L is subsequently interrupted in this process, and a transition is made to the inspection of a second dot-pattern row L formed apart from the interrupted dot-pattern row (dot pattern inspection row transition process (step)) in cases in which the sequentially acquired inspection values of the dot patterns P exceed predetermined thresholds established in advance according to the inspection values.

Specifically, in the present embodiment, the controller 105 makes a determination as to whether or not the surface area of the dot patterns P included in the dot-pattern row La1 is greater than the value of 1.5 times (predetermined threshold) the normally expected dot pattern surface area (step S5). This threshold is based on experimental data and empirical rule, and the value thereof can be varied as deemed appropriate.

In cases in which the surface area of the dot patterns P is equal to or less than a value 1.5 times the surface area of the normally expected dot pattern, the controller 105 continues inspection and makes a determination as to whether or not inspection of the dot patterns P up to the rightmost end (other end) of the dot-pattern row La1 has ended (step S6). In the case that it is determined to have not ended, the controller 105 causes the inspection camera 66 to make a transition and acquire an image of the next inspection region R, and connects the image on the basis of the coordinates of the dot pattern P (e.g., the dot pattern P21) for image connection (step S7). The process then returns to step S4, and the dot patterns P up to the rightmost end of the dot-pattern row La1 are inspected (steps S4 to S7).

In cases in which the surface area of the dot patterns P is greater than a value 1.5 times the normally expected surface area of the dot patterns, the controller 105 determines that the dot-pattern row La1 being inspected contains a dot pattern NG and cannot be properly inspected, and that inspecting the remaining dot patterns P would be ineffective. The controller 105 then interrupts the inspection of the dot-pattern row La1 (step S11).

The controller 105 then causes the row being inspected by the discharge inspection unit 4 to make a transition from the interrupted dot-pattern row La1 to the adjacent uninspected dot-pattern row Lb1 (step S12).

The second dot-pattern row L to which a transition is made to perform an inspection may be the dot-pattern row La2 formed from the same nozzle row 42*a*, but the movement distance of the inspection camera 66 and other components is longer than for the dot-pattern row Lb1, and more time is required for making a transition to the inspection row. Therefore, the controller 105 makes a transition to inspect the nearest dot-pattern row Lb1, and less time is needed to make a transition to a different inspection row.

Next, step S12 of this process is followed by a return to step S3, and an imaging process is used to sequentially acquire and inspect predetermined inspection values based on the shapes of the dot patterns P for every dot pattern P included in the dot-pattern row Lb1. In this inspection, the controller 105 causes the discharge inspection unit 4 to inspect the dot-pattern row Lb1 all the way to the rightmost end (steps S4 to S7) in cases in which the surface area of the dot patterns P does not indicate a value greater than 1.5 times the normally expected surface area of the dot patterns.

When inspection of the dot-pattern row Lb1 has ended, the controller 105 then makes a determination as to whether or not the end has been reached in the inspection of the dot-pattern row La1 or La2 and the dot-pattern row Lb1 or Lb1 (step S8). Specifically, a determination is made as to whether or not the end has been reached in the inspection of a single dot-pattern row L corresponding to the nozzle row 42*a*, and whether or not the end has been reached in the inspection of a single dot-pattern row L corresponding to the nozzle row 42*b*.

In the case that the inspections are determined to have not ended, the controller 105 makes a transition to inspect an uninspected dot-pattern row L (step S12). In this example, the transition is made to inspect the dot-pattern row La2 adjacent to the dot-pattern row Lb1. In this inspection, the controller 105 causes the discharge inspection unit 4 to inspect the dot-pattern row La2 all the way to the rightmost end (step S3 to S7) in the case that the surface area of the dot patterns P does not indicate a value greater than 1.5 times the normally expected dot pattern surface area.

In step 8, the controller 105 ends the functional liquid droplet discharge head inspection process (step S9) if the inspection of the dot-pattern rows L corresponding to the nozzle rows 42 has ended.

Since inspection of the dot-pattern row Lb2 is covered by inspection of the dot-pattern row Lb1 formed by the same nozzle row 42*b*, this inspection is not performed. Another reason for not performing this inspection is to reduce the inspection time.

The maintenance process is performed before the next actual drawing process if the controller 105 determines that there is a misalignment in the position (a distortion in the trajectory) where droplets of the functional liquid droplets are deposited or whether a droplet has or has not been discharged (a nozzle is clogged) on the basis of the inspection results of the functional liquid droplet discharge head inspection process and deviations from normal operation are confirmed.

Therefore, according to the present embodiment described above, there is provided a discharge inspection unit 4 for inspecting a plurality of dot patterns P of functional liquid droplets discharged from the nozzle rows 42 of the functional liquid droplet discharge heads 17, the discharge inspection unit using a configuration having a controller 105 for executing a dot-pattern row formation process in which functional liquid droplets are discharged at least twice from the nozzle rows 42 onto mutually different positions on the inspection roll paper S to form the dot-pattern rows in a plural number L; a dot pattern inspection process in which a single specified row is selected from among the resulting plurality of dot-pattern rows L and in which an imaging process is used to sequentially acquire and inspect predetermined inspection values based on the shapes of dot patterns P for each of the dot patterns P included in the dot-pattern row L; and a dot pattern inspection row transition process in which the inspection of the selected dot-pattern row L is interrupted in the case that the sequentially acquired predetermined inspection values exceed a predetermined threshold established in advance according to the predetermined inspection values, and a transition is made to inspect a second dot-pattern row L formed apart from the interrupted dot-pattern row.

Using such a configuration makes it possible in the present embodiment to discharge droplets at least twice from the same nozzle row 42 onto inspection roll paper, to form a plurality of inspection dot-pattern rows L in advance, and to proceed with inspection using a second dot-pattern row L formed in a different position from the first dot-pattern row in which defects are present. There is no need to form another dot pattern P on the inspection roll paper S and make another inspection, and the time for inspecting the dot patterns P can be reduced.

Figure 8:
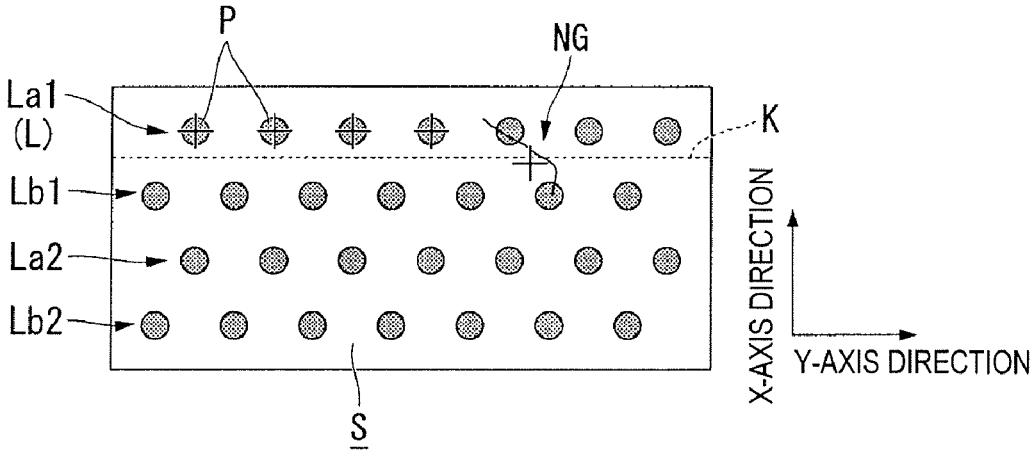
FIG. 8 is a view showing a plurality of dot-pattern rows formed on inspection roll paper according to an embodiment of the present invention.

In a case such as is shown in FIG. 8, the controller 105 is preferably configured to execute the following process so as to reduce the time for inspecting the dot patterns P.

FIG. 8 shows a situation in which the mutually adjacent dot patterns P of the dot-pattern row La1 and dot-pattern row Lb1 have joined together.

In such a case, if inspection of the dot-pattern row La1 is interrupted and a transition is made to the dot-pattern row Lb1, the inspection of the dot-pattern row Lb1 must also be interrupted because the rows are joined by the dot pattern NG. The inspection time thus increases.

In the dot pattern inspection row transition process described above, the controller 105 interrupts inspection of the selected dot-pattern row L in cases in which the sequentially acquired barycentric positions of the dot patterns P are detected as having exceeded the predetermined threshold on either side in a direction orthogonal to the row direction of the selected dot-pattern row L, and the controller makes a transition to inspect a second dot-pattern row L formed apart from both the interrupted dot-pattern row L and the dot-pattern row L formed adjacent to the side on which the predetermined threshold is determined to have been exceeded.

Specifically, the controller 105 determines whether or not the barycentric positions of the dot patterns P acquired from the dot-pattern row La1 are misaligned in a direction (X-axis direction) orthogonal to the row direction and have been detected as exceeding a value somewhat less than half the distance between dot-pattern rows (for example, a value 0.3 times the distance between dot-pattern rows, which is the predetermined threshold, as shown by dotted line K in FIG. 8) toward the dot-pattern row Lb1. This threshold is based on experimental data and empirical rule, and the value thereof can be varied as deemed appropriate.

Specifically, the barycentric positions of the dot patterns P are detected as being misaligned in the X-axis direction when the dot pattern NG joins the rows. The controller 105 determines that the dot pattern NG "connects the same row" when the barycentric positions of the dot patterns P do not exceed the aforementioned threshold, and determines that the dot pattern NG "connects adjacent rows" when the barycentric positions of the dot patterns P exceed the aforementioned threshold.

When the controller 105 determines that the dot pattern NG "connects adjacent rows," the controller 105 passes over the dot-pattern row La1 and the dot-pattern row Lb1 connected by the dot pattern NG (i.e., skips the dot-pattern row Lb1), and makes a transition to inspect the other dot-pattern row La1 or Lb2.

Executing a process such as the one described above makes it possible to determine, in the case that the barycentric positions of the dot patterns P are misaligned to either side in the direction orthogonal to the dot-pattern row L, that the dot patterns P are joined with dot patterns P in a dot-pattern row L adjacent to the first dot-pattern row L on this side. Specifically, there is a high probability that the dot-pattern row L on this side will exhibit abnormal values when inspected. Therefore, it is possible to avoid ineffective inspections and to contribute to reducing inspection time by passing over this dot-pattern row L and inspecting another dot-pattern row L.

The preferred embodiment of the present invention was described above with reference to the drawings, but the present invention is not limited to this embodiment. The shapes, combinations, and other features of the structural components portrayed in the embodiment described above represent but one example, and various modifications can be made based on the design requirements and the like within a range that does not deviate from the scope of the invention.

For example, in the embodiment described above, the droplet discharge heads were described as having two nozzle rows, but the present invention can also be applied to the inspection of droplet discharge heads having only one nozzle row. In this case, a method may be used in which droplets are discharged three times from the nozzle row, forming three dot-pattern rows.

For example, in the embodiment described above, the dot-pattern row and the next inspection region are photographed by an inspection camera, but the inspection photography unit may be provided with a drawing observation camera having a high resolution and a narrow viewing angle, and a region camera having a low resolution and a wide viewing angle, and dot-pattern rows may be photographed by the drawing observation camera while inspection regions may be photographed by the region camera.

The present invention can also be applied, for example, to a droplet discharge device for spraying droplets (a liquid substance) in which electrode materials, color materials, and other materials used in the manufacture of liquid crystal displays, EL (electroluminescence) displays, and surface-emitting displays (FEDs) have been dispersed (dissolved) in a predetermined dispersion medium (solvent).

The droplet discharge device may also be a droplet discharge device for spraying a bioorganic substance used in the manufacture of biochips, or a droplet discharge device used as a precision pipette with which droplets are sprayed as specimens.

Furthermore, the device may be a droplet discharge device for spraying lubricating oil on a clock, a camera, or another precision mechanism in pinpoint fashion; a droplet discharge device for spraying an ultraviolet curing resin or another transparent resin liquid onto a substrate in order to form a miniature semispherical lens (optical lens) used in an optical communication element or the like; a droplet discharge device for spraying an acid, an alkali, or another etching liquid in order to etch a substrate or the like; a fluid-spraying device for spraying a gel; or a toner jet recording device for spraying a solid substance, an example of which could be a toner or another powder. The present invention can be applied to any one of these types of droplet discharge devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for inspecting a droplet discharge head comprising:

discharging a plurality of droplets on an inspection workpiece from a nozzle row of the droplet discharge head at least twice in different positions on the inspection workpiece thereby forming a plurality of dot pattern rows each including a plurality of dot patterns;

inspecting each of the dot patterns included in a first dot pattern row among the dot pattern rows by sequentially acquiring, using an image processing, a predetermined inspection value of the each of the dot patterns determined based on a shape of the each of the dot patterns; and initiating inspection of a second dot pattern row among the dot pattern rows when inspection of the first dot pattern row is interrupted upon one of the predetermined inspection values sequentially acquired exceeding a predetermine threshold established in advance according to a type of the predetermined inspection value.

2. The method for inspecting a droplet discharge head according to claim 1, wherein the initiating of the inspection of the second dot pattern row includes initiating the inspection of the second dot pattern row, which is adjacent to the first dot pattern row.

3. The method for inspecting a droplet discharge head according to claim 1, wherein the inspecting of the each of the dot patterns includes using a value of the surface area of the each of the dot patterns as the predetermined inspection value.

4. The method for inspecting a droplet discharge head according to claim 1, wherein the inspecting of the each of the dot patterns includes using a value of the barycentric position of the each of the dot patterns as the predetermined inspection value.

5. The method for inspecting a droplet discharge head according to claim 4, wherein the initiating of the inspection of the second dot pattern row includes interrupting the inspection of the first dot pattern row when one of the barycentric positions of the dot patterns sequentially acquired deviates in a direction orthogonal to a row direction of the first dot pattern row by an amount exceeding the predetermined threshold, and initiating the inspection of the second dot pattern row disposed adjacent to the first dot pattern row on a side of the first dot pattern row toward which the one of the barycentric positions deviates by the amount exceeding the predetermined threshold.

6. A device for inspecting a droplet discharge head comprising:

a drive unit configured and arranged to drive the droplet discharge head to discharge a plurality of droplets on an inspection workpiece from a nozzle row of the droplet discharge head at least twice in different positions on an inspection workpiece thereby forming a plurality of dot pattern rows each including a plurality of dot patterns;

an inspection photography unit configured and arranged to capture an image of the dot patterns formed on the inspection workpiece; and a control unit configured to inspect each of the dot patterns included in a first dot pattern row among the dot pattern rows by sequentially acquiring, using an image processing, a predetermined inspection value of the each of the dot patterns determined based on a shape of the each of the dot patterns captured in the image by the inspection photography unit, to stop inspection of the first dot pattern row upon one of the predetermined inspection values sequentially acquired exceeding a predetermine threshold established in advance according to a type of the predetermined inspection value, and to initiate inspection of a second dot pattern row among the dot pattern rows after stopping the inspection of the first dot pattern row.

7. The device for inspecting a droplet discharge head according to claim 6, wherein the control unit is configured to initiate the inspection of the second dot pattern row, which is adjacent to the first dot pattern row.

8. The device for inspecting a droplet discharge head according to claim 6, wherein the predetermined inspection value includes a value of the surface area of the each of the dot patterns.

9. The device for inspecting a droplet discharge head according to claim 6, wherein the predetermined inspection value includes a value of the barycentric position of the each of the dot patterns.

10. The device for inspecting a droplet discharge head according to claim 9, wherein the control unit is further configured to stop the inspection of the first dot pattern row when one of the barycentric positions of the dot patterns sequentially acquired deviates in a direction orthogonal to a row direction of the first dot pattern row by an amount exceeding the predetermined threshold, and to initiate the inspection of the second dot pattern row disposed adjacent to the first dot pattern row on a side of the first dot pattern row toward which the one of the barycentric positions deviates by the amount exceeding the predetermined threshold.

11. A droplet discharge device including the device for inspecting a droplet discharge head according to claim 6.

* * * * *